US005600889A

United States Patent [19]

Marotta

[11] Patent Number: 5,600,889

[45] Date of Patent: Feb. 11, 1997

[54] DETACHABLE LID SUPPORT WITHIN A FOOD SERVER

[76] Inventor: Irene F. Marotta, 460 Ridge Rd., Webster, N.Y. 14580

[21] Appl. No.: 548,055

[22] Filed: Oct. 25, 1995

[51] Int. Cl.[6] ..... A47G 21/04; B65D 85/36

[52] U.S. Cl. ..... 30/142; 30/327; 206/525; 206/551

[58] Field of Search ..... 30/296.1, 322–328, 30/142, 147, 148, 149; 206/223, 542, 551, 525

[56] References Cited

U.S. PATENT DOCUMENTS

| | | | |
|---|---|---|---|
| D. 237,449 | 11/1975 | Montesi | 30/148 |
| 2,789,349 | 4/1957 | Lee | 30/327 |
| 2,995,265 | 8/1961 | Soderberg | 30/327 |
| 3,174,223 | 3/1965 | Gerson | 30/142 |
| 4,498,586 | 2/1985 | Vitale | 206/525 |
| 4,877,609 | 10/1989 | Beck et al. | 206/551 X |
| 5,480,031 | 1/1996 | Maultasch et al. | 206/525 |

*Primary Examiner*—Hwei-Siu Payer
*Attorney, Agent, or Firm*—Cumpston & Shaw

[57] ABSTRACT

An article for supporting the lid of a cardboard box for a food item. The article, or preferably a utensil, comprises a blade having a detachable spacer releasably connected to the blade and a handle attached to the blade. The detachable spacer has a cover support and at least one vertical extending leg to contact a food article, yet at the same time, protect the food article. The handle may extend substantially parallel to, but offset from, the blade and has an top surface which may include advertising indicia thereon.

20 Claims, 8 Drawing Sheets

DETACHABLE LID SUPPORT WITHIN A FOOD SERVER

FIELD OF THE INVENTION

The present invention generally relates to a food product container support, and more particularly, to a food product container support releasably connected to a food serving utensil in combination with a food product container. The food product container support provides support for a cover of the food product container.

BACKGROUND OF THE INVENTION

When items, such as food, are packaged within boxes which have relatively large covers, the central portion of the cover can bend, flex or sag down onto the food item, thereby damaging it. This is especially true when the boxes are stacked for storage or delivery.

Several devices have been utilized to help prevent the sagging of the covers. Such devices are placed centrally on the food product to support the cover during storage and delivery. The device is usually a unitary structure and in its preferred form has spaced vertical legs which are connected to a cover support.

Other devices include combination serving utensils and pizza container supports. Such devices have a server portion appropriate to serve a slice of pizza and an upstanding portion which has a vertical dimension, which, when the server portion is placed between the pizza and the base of the container, approximates the height of the pizza container. These devices also contain a handle portion which has a fiat upper surface and is attached to the upper end of the upstanding portion. The handle extends parallel to, but offset from, the server portion. However, these devices need to be placed beneath the food item and protrude through the center portion of the food product. This tends to disfigure the food product and also contaminate the utensil with portions of the food product.

A need still exists for a serving utensil which can serve dual purposes. The utensil needs to protect the food during storage or delivery while subsequently assist in serving the food.

SUMMARY OF THE INVENTION

The present invention generally relates to a food serving utensil for assisting the serving of a food article comprising a blade, a handle attached to the blade, and a detachable spacer releasably connected to one of the blade and the handle, the detachable spacer including at least one leg extending in a vertical direction a sufficient distance such that upon one of the handle and the blade being adjacent the food article, the leg extending from the remaining one of the handle and blade prevents an adjacent portion of the one of the blade and handle from contacting the food article.

DETAILED DESCRIPTION OF THE PREFERRED EMBODIMENT

Figure 1:
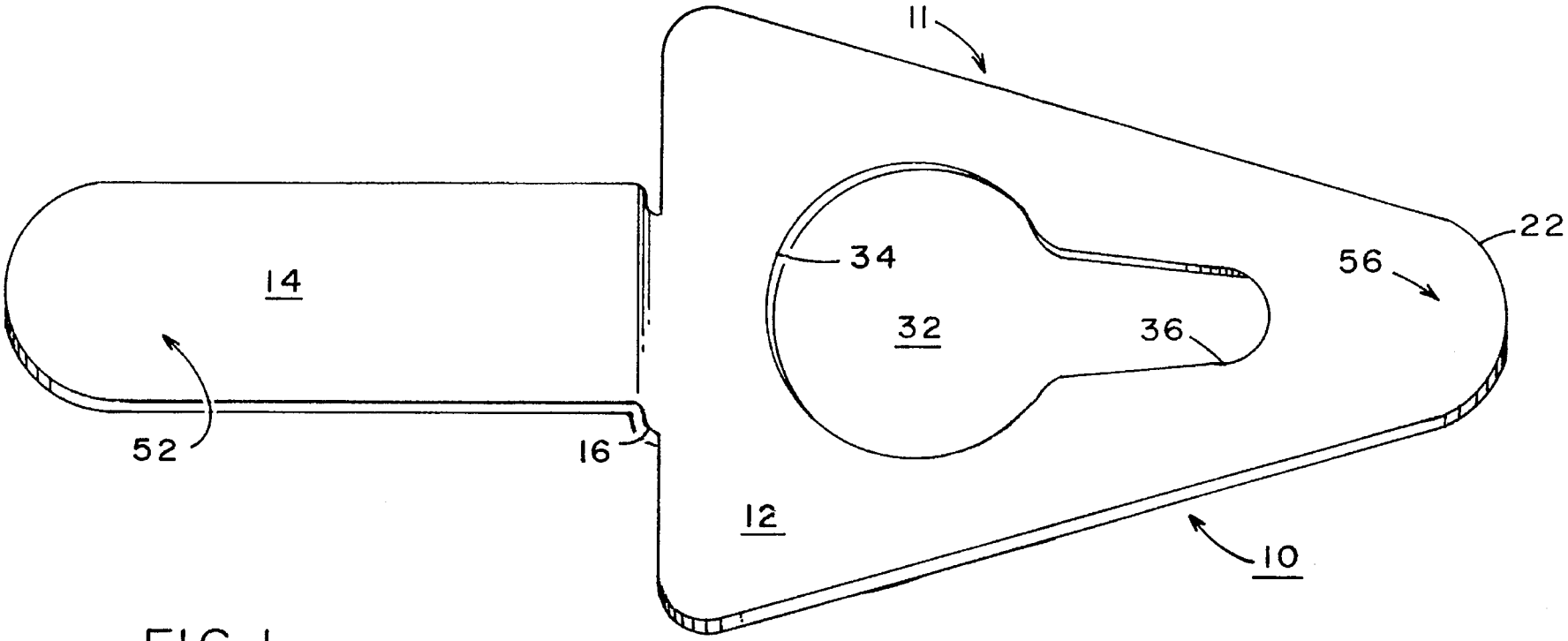
FIG. 1 is a top view of the utensil according to the invention.

Referring to FIG. 1, a preferred embodiment of the utensil is shown in detail. The utensil 10 may be a pizza server 11, having a blade 12 and a handle 14.

Figure 5:
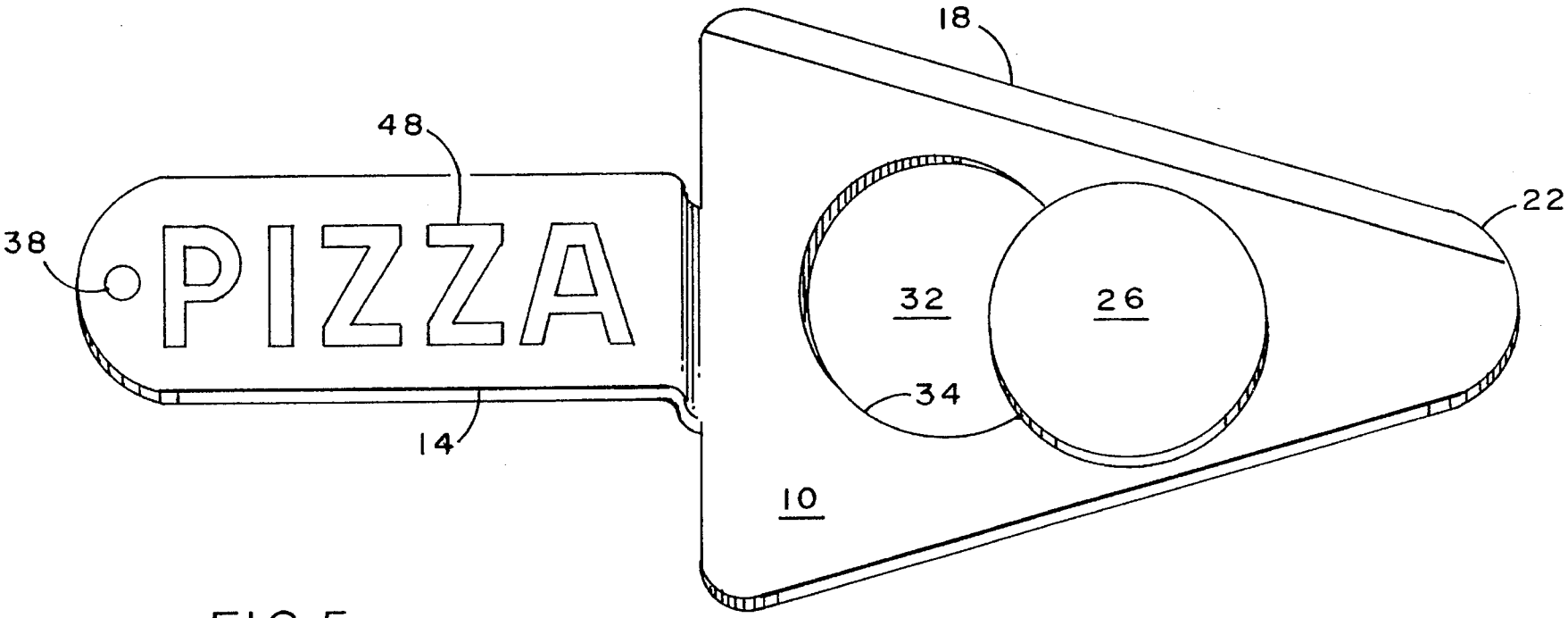
FIG. 5 is a top view of the utensil illustrating a straight edge on the blade and advertisement on the handle.
Figure 6:
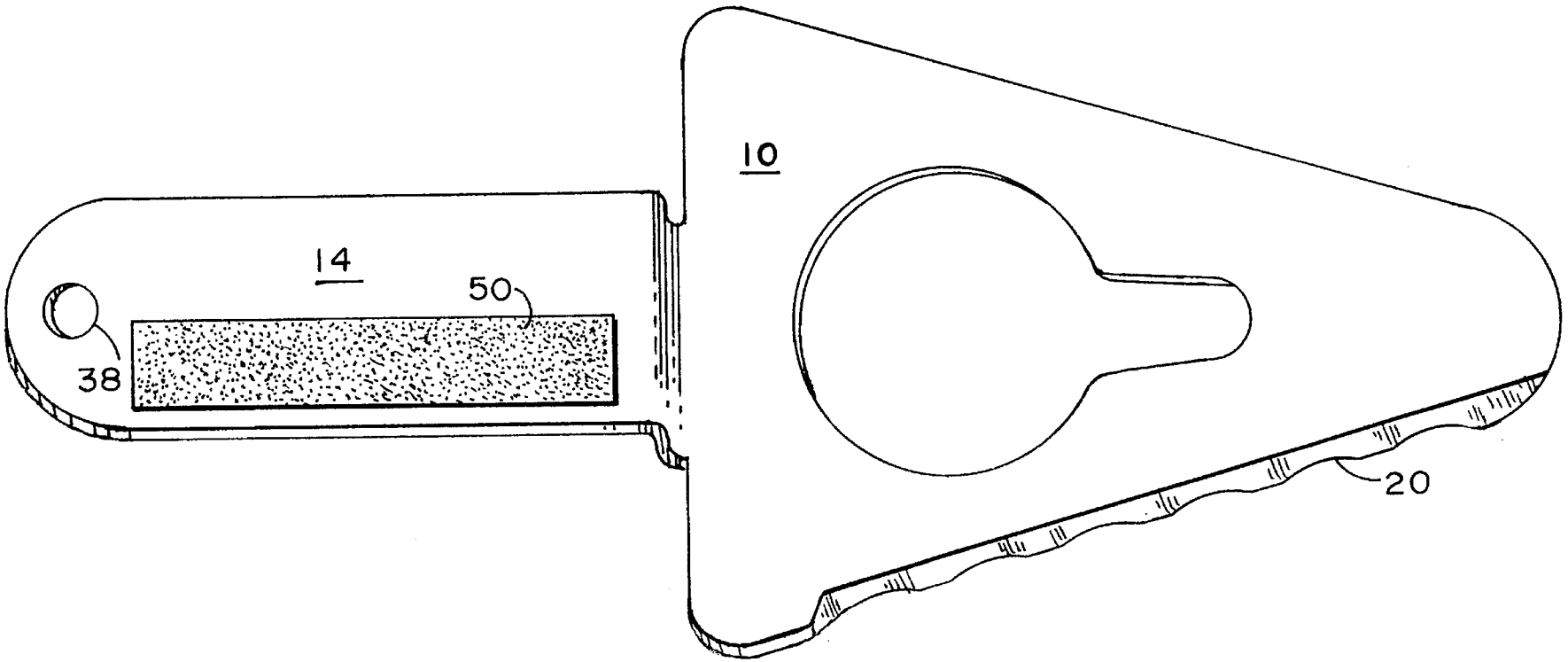
FIG. 6 is a top view of the utensil illustrating a serrated edge on the blade and the handle having a textured surface.

Preferably, the handle 14 will be approximately in the range of 3" to 4" long and approximately 1" to 1½ wide. These dimensions can be varied, though the handle 14 should be dimensioned so as to comfortably accommodate the server's hand. The handle 14 is shown substantially parallel to, but vertically offset from, the blade 12. It is understood the handle 14 and blade 12 may be inclined relative to each other. The handle 14 includes a top surface 52 which is greater than its vertical dimension for displaying information thereon. The top surface of the handle 14 may include advertising slogans or names done in intaglio or raised lettering 48 (as shown in FIG. 5). The top surface 52 may further include a textured portion 50 (as shown in FIG. 6) in addition to or as an alternative to raised or indented indicia. The handle 14 may also be smooth to receive an adhesive label or screen printing. Preferably, the handle 14 includes an aperture 38 to allow the utensil to be hung on a pin or other storing device. (See FIGS. 5 and 6, pin not shown).

Referring to FIGS. 1 through 9, the blade 12 will be approximately 6" in length, as this size is preferable to cut and serve 8" to 14" pizza. It is understood, however, that this dimension can vary, depending on the size of the pizza or food product to be served. The blade 12 includes an upper surface 56 which may include advertising much like the top surface 52 previously mentioned. As shown in FIG. 6, one edge of the blade may have serrated edges 20 to finish cutting any partial radial cuts in the pizza. A second edge of the blade may include a fairly sharp edge 18 to sever any remaining strings of cheese of the pizza (see FIG. 5). A pointed front end 22 of the blade 12 is provided to aid in inserting the blade 12 between the pizza or food article and the base portion of the food container. While the blade 12 is shown as being wedged shaped, other shapes (rectangular, square, etc.) more convenient for serving other types of food products may be used without departing from the invention.

Figure 2:
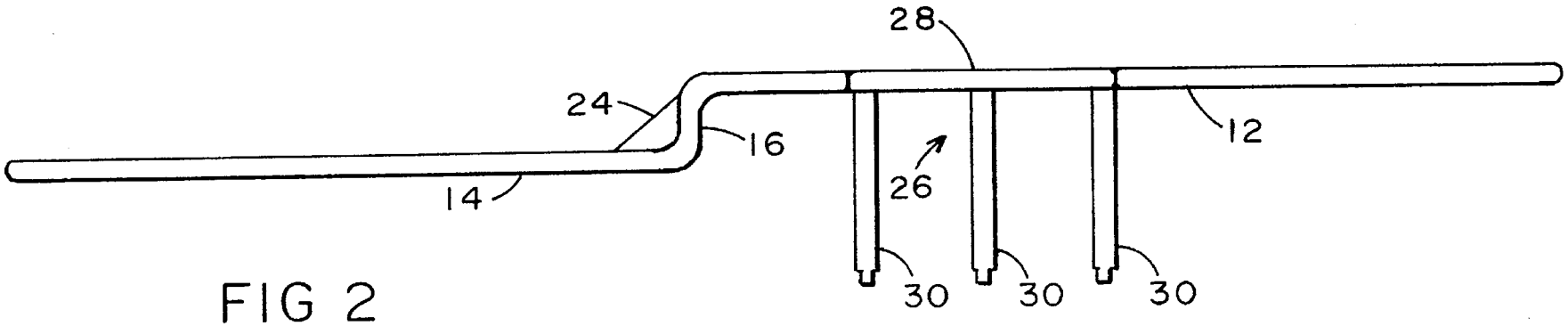
FIG. 2 is a side view of the utensil.

In a preferred embodiment, the handle 14 and blade 12 are connected by an upstanding portion 16. As is best illustrated in FIG. 2, the blade 12 is substantially perpendicular to the upstanding portion 16, though the upstanding portion 16 may extend downward from the blade at about 5 degrees from the vertical. This slight variation is to facilitate injection molding. However, the upstanding portion 16 may be inclined from 30° to 90°. The vertical dimension of the upstanding portion 16 may be of sufficient height to support the cover of the food container. Preferably, this height would be between ½ to 2½. The height of the upstanding portion 16 may be increased or decreased depending upon the container in which it is to support. In addition, the upstanding portion 16 may include a reinforcing web, ribs, or ridges 24 for structural support.

Figure 8:
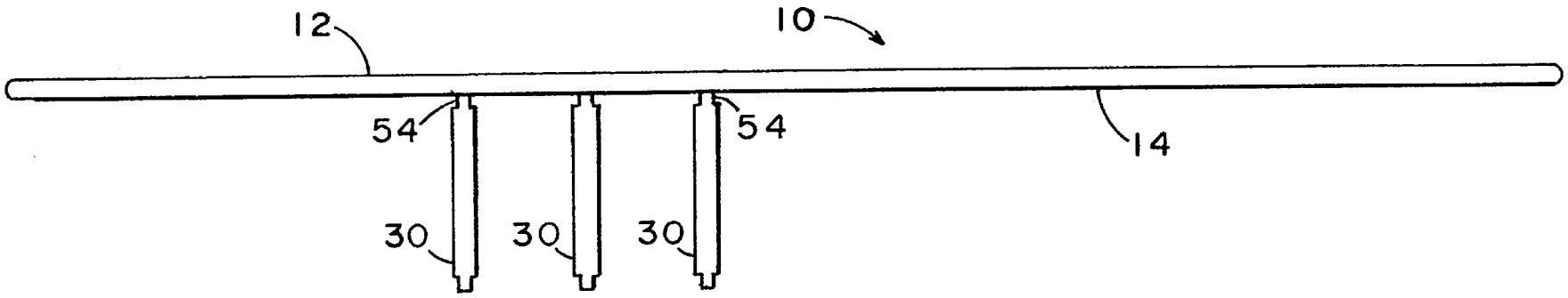
FIG. 8 illustrates an alternative embodiment whereby the handle and blade lie in the same plane.

In an alternative embodiment, the blade 12 and handle 14 are attached to one another and lie in the same plane (see FIG. 8).

Figure 3:
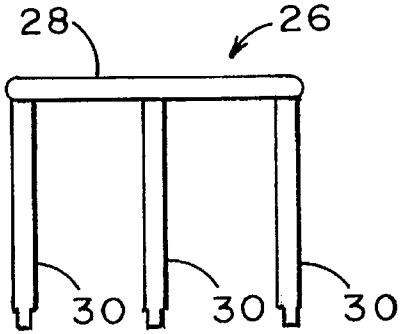
FIG. 3 is a side view of the cover support.
Figure 4:
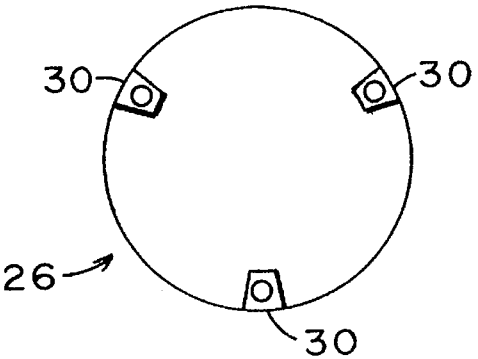
FIG. 4 is a bottom view of the cover support.

A detachable spacer 26 is releasably connected to one of the blade 12 and handle 14. Preferably, the spacer 26 is located within the periphery of the blade 12. (See FIGS. 2 and 7). Referring to FIG. 3, the detachable spacer 26 includes at least one spaced vertical leg 30 connected to a cover support 28. The lower portions of the legs 30 have a minimal cross section to minimize any marking of the protected article, and they are made thin for minimizing the volume of manufacturing material required (see FIG. 4). The cover support 28 of the detachable spacer 26 also preferably has a minimum volume. The cover support 28 is preferably in the shape of a flat disc, as shown in FIGS. 2, 3, 4, 5, and 7. However, the cover support 28 may be any of a variety of shapes such as oval, rectangular, square or polygonal. The detachable spacer 26 allows the entire area of the blade 12 to act as a support for the cover or lid of the container.

Figure 9:
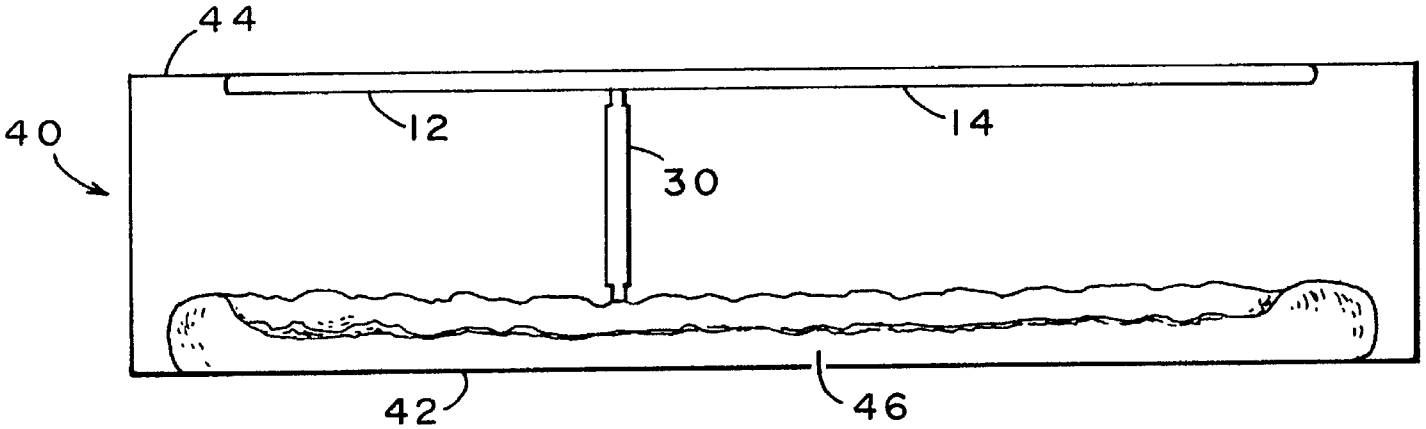
FIG. 9 illustrates an alternative embodiment in an operable position.

FIG. 9 illustrates an alternative embodiment whereby the detachable spacer 26 may be at least one leg 30. The leg 30 includes a point of weakness 54 near its juncture with the blade 12 to facilitate detachment. The blade 12 would remain intact as a full blade with no aperture in its periphery.

Figure 7:
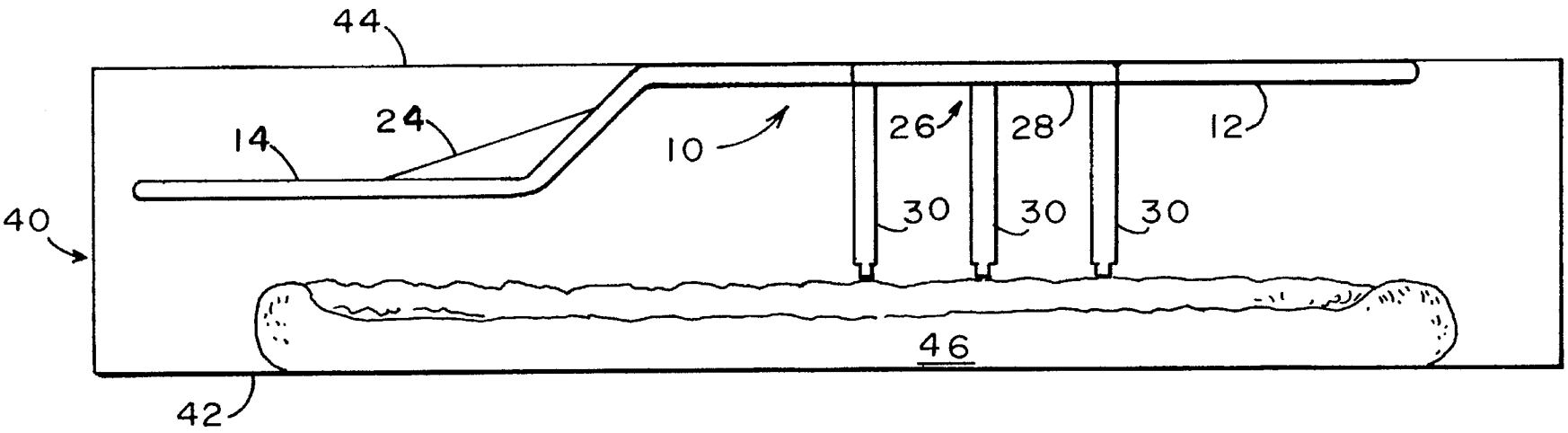
FIG. 7 illustrates the utensil in combination with a food article and a food article container.

Referring to the embodiment of FIG. 1, the aperture 32 includes an expansion hole 34 and an elongated slot 36. The detachable spacer 26 is first inserted into the expansion hole 34 and pushed into the narrower elongated slot 36 to securely attach itself to the blade 12. (As shown in FIGS. 2, 5 and 7). The detachable spacer 26 is slid into an operable position through an aperture 32 within the periphery of the blade 12 (see FIG. 5).

Referring to FIG. 7, a typical pizza container 40 is shown having a base 42 and a cover 44 having overall dimensions adequate to hold a pizza pie or other food product 46. The inside height is adequate to not only contain the pizza 46 but to provide at least some space above the pizza to accommodate the varying thickness of the pizza and its toppings and any slight flexing of the cover 44 towards the top of the pizza 46, and thus prevent at least crushing contact between the cover 44 and the upper surface of the pizza. The pizza, as is typical in the take-out or frozen pizza industry, has several radial cuts which form serving size pieces having the characteristic wedge shape. The utensil 10, in an operable position, is placed over the food article 46 so that the legs 30 of the spacer 26 contact the food article 46 and space the remaining portion of the utensil 10 from the food article 46, as well as support the cover 44. The vertical offset between the blade 12 and the handle 14 (as may be defined by the upstanding portion 16) may be less than the dimension of the spacer 26 in the vertical direction. That is, upon the spacer 26 contacting the food article 46, both the handle 14 and the blade 12 are spaced from the food article 46. The spacer 26 has a sufficient length to preclude a substantial portion of the handle 14 from contacting the food article 46.

Figure 10:
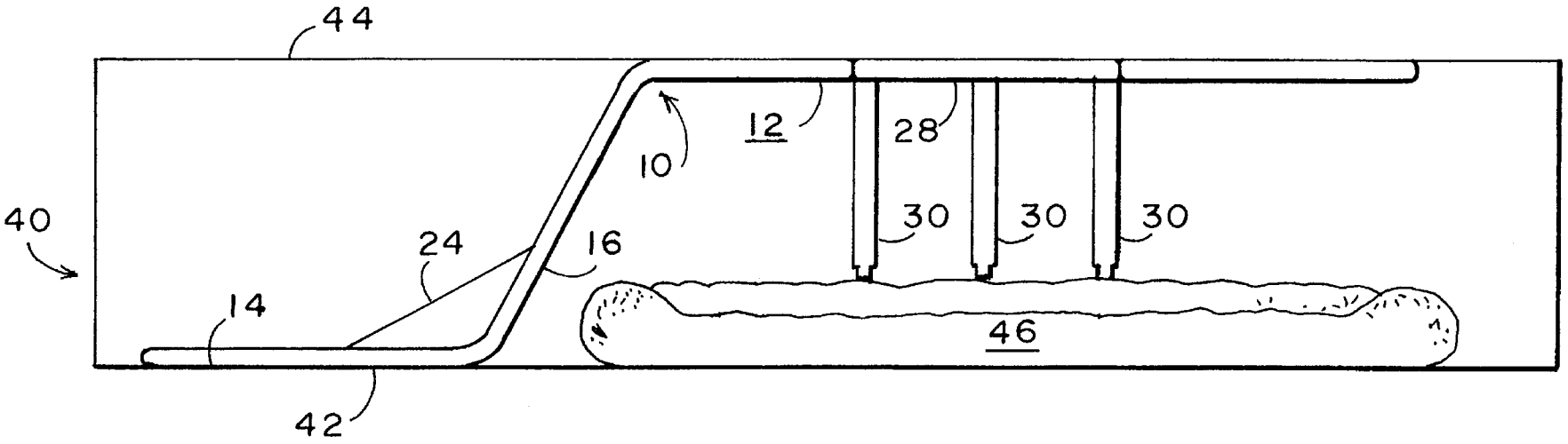
FIG. 10 illustrates an alternative embodiment in an operable position.

In an alternative embodiment, as shown in FIG. 10, the handle 14, in an inverted position, is positioned such that the handle 14 will contact the comer of the container 40 and will rest on the base 42 of the container 40. The handle has a length which may be selected to preclude overlying the food article 46, while locating the blade 12 and the spacer 26 to overlie the food article. The plurality of vertical legs 30 extending from the detachable spacer 26 provide support for the blade 12 which is in contact with the cover 44 of the food container 40. The handle 14 of the utensil 10, in an operable position, is placed on the base of the container 42 to extend from the corner of the box 40 toward an opposing comer.

FIG. 9 also shows an alternative embodiment whereby the blade 12 and handle 14 lie in the same plane and contact the cover 44 of the container 40. At least one of the legs 30 extend in a vertical direction a sufficient distance such that upon one of the handle 14 and the blade 12 being adjacent the food article 46, the leg or legs 30 extending from the remaining one of the handle 14 and blade 12 prevents an adjacent portion of the one of the blade 12 and the handle 14 from contacting the food article 46 and provides support for the utensil 10 and cover 44.

The handle 14, blade 12, and spacer 26 (and upstanding portion 16 if used) are selected so that the distance between the cover 44 and the anticipated food article 46 is substantially spanned by the utensil. That is, the utensil 10 is sized to span the distance between the food article 46 and the cover 44.

Figure 11:
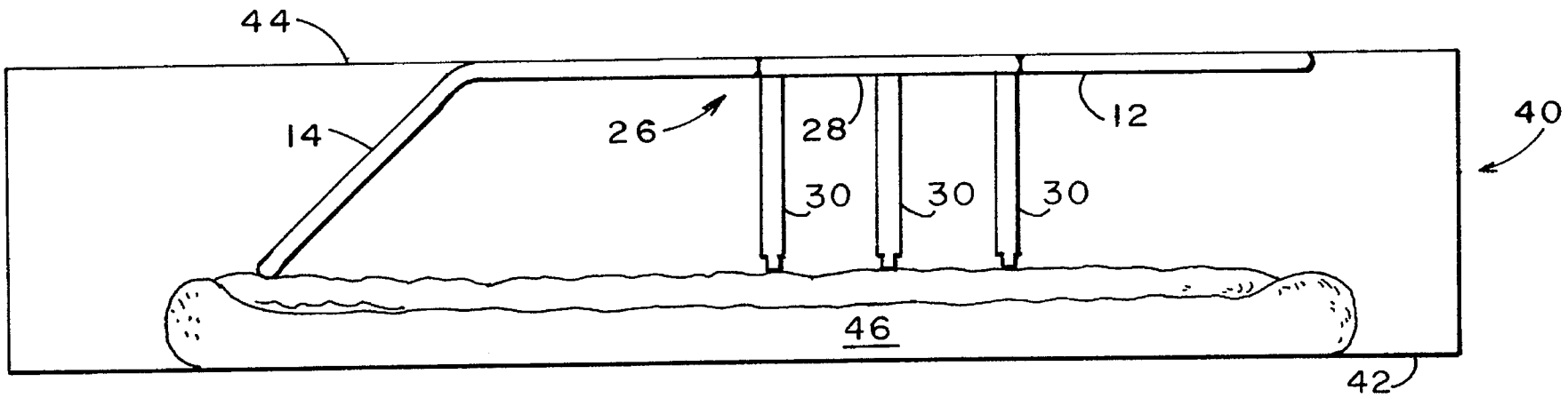
FIG. 11 illustrates another alternative embodiment.

FIG. 11 illustrates another alternative embodiment whereby the handle 14 extends from the blade 12 in a range of approximately between 90° and 180°. The spacer 26 has a sufficient length to preclude a substantial portion of the handle 14 from contacting the food article 46.

The present invention is preferably made of a lightweight, inexpensive material, such as plastic, thermosetting plastic, heat resistant plastic, or any suitable material.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims which scope is to be accorded the broadest interpretation so as to encompass all such modifications and equivalent structures.

What is claimed is:

1. A food serving utensil for assisting the serving of a food article, comprising:

a blade, a handle attached to the blade, the handle interconnected to the blade by an upstanding portion, and a detachable spacer releasably connected to one of the blade and the handle, the detachable spacer including at least one leg extending in a vertical direction a sufficient distance such that upon one of the handle and the blade being adjacent the food article, the leg extending from the one of the handle and the blade prevents an adjacent portion of the one of the blade and the handle from contacting the food article; and the blade includes an aperture within the periphery of the blade, the aperture sized to frictionally retain a portion of the spacer.

2. A food serving utensil for assisting the serving of a food article, comprising:

a blade;

an upstanding portion having an upper and a lower end, the upstanding portion attached to the blade at the upper end, and having a dimension generally perpendicular to the blade;

a handle attached to the lower end of the upstanding portion substantially parallel to, but vertically offset from, the blade; and a detachable spacer releasably connected to one of the blade and the handle, the detachable spacer including at least one leg extending in a vertical direction a sufficient distance such that upon one of the handle and the blade being adjacent the food article, the leg extending from one of the handle and blade prevents an adjacent portion of one of the blade and handle from contacting the food article.

3. A food serving utensil for assisting the serving of a food article, comprising:

a blade, a handle attached to the blade, the handle interconnected to the blade by an upstanding portion, and a detachable spacer releasably connected to one of the blade and the handle, the detachable spacer including at least one leg extending in a vertical direction a sufficient distance such that upon one of the handle and the blade being adjacent the food article, the leg extending from the one of the handle and the blade prevents an adjacent portion of the one of the blade and the handle from contacting the food article.

4. The utensil as defined in claim 3 wherein the spacer is a leg.

5. The utensil as defined in claim 3, wherein the blade includes an aperture within the periphery of the blade, the aperture sized to releasably retain the spacer.

6. The utensil as defined in claim 3, wherein the aperture further comprises an expansion hole and an elongated slot.

7. The utensil as defined in claim 3 further comprising a serrated edge along an edge of the blade.

8. The utensil as defined in claim 3 further comprising a sharp straight edge along a second edge of the blade.

9. The utensil as defined in claim 3 wherein the blade includes a pointed end for inserting the blade between a food product and a base of a container box.

10. The utensil as defined in claim 3 wherein the detachable spacer comprises a cover support and at least one spaced vertical leg connected to the cover support.

11. The utensil as defined in claim 10 wherein the cover support is a generally flat disc.

12. The utensil as defined in claim 1 wherein said detachable spacer further comprises a plurality of vertical legs with a minimal cross section to minimize any marking of the food article.

13. The utensil as defined in claim 3 wherein the handle includes a top surface which is greater than its vertical dimension for displaying information thereon.

14. The utensil as defined in claim 3 wherein the handle includes a textured portion.

15. The utensil as defined in claim 3 wherein the upstanding portion extends downward from the blade at about 5 degrees from a vertical axis.

16. The utensil as defined in claim 1 further comprising a support web integral with the upstanding portion.

17. The utensil as defined in claim 3 wherein the blade is formed of a thermosetting plastic.

18. The utensil as defined in claim 3 wherein the utensil is formed of a heat resistant plastic.

19. The utensil as defined in claim 3 in combination with a container for the food article, the container including a base and a cover defining a space therebetween.

20. The utensil as defined in claim 1 wherein the upstanding portion is encompassed within a portion of one of the blade and the handle.

* * * * *